United States Patent [19]

de la Cuadra Herrera et al.

[11] 3,974,254

[45] Aug. 10, 1976

[54] PROCESS FOR PURIFYING METALLURGICAL GASES CONTAINING SULPHUROUS ANHYDRIDE BY EXTRACTING MERCURY

[75] Inventors: Antonio de la Cuadra Herrera; Miguel Fernandez Tallante; Armando Rodriguez Sanchez, all of Madrid, Spain

[73] Assignee: Patronato de Investigacion Cientifica y Tecnica "Juan de la Cierva" del Consejo Superior de Investigaciones Cientificas, Madrid, Spain

[22] Filed: Dec. 10, 1973

[21] Appl. No.: 423,001

[30] Foreign Application Priority Data

Jan. 29, 1973 Spain ..... 411067

[52] U.S. Cl. ..... 423/210; 423/101

[51] Int. Cl.[2] ..... B01D 47/00

[58] Field of Search ..... 55/72; 75/108, 121; 423/101, 106, 210, 531

[56] References Cited

UNITED STATES PATENTS

| | | | |
|---|---|---|---|
| 3,145,080 | 8/1964 | Jockers et al. | 423/531 |
| 3,689,217 | 9/1972 | Capaul et al. | 423/531 |
| 3,695,838 | 10/1972 | Knepper et al. | 425/106 |
| 3,701,651 | 10/1972 | Hack et al. | 75/109 |
| 3,826,819 | 7/1974 | Orlandini et al. | 423/531 |
| 3,838,190 | 9/1974 | Birke et al. | 423/491 |

OTHER PUBLICATIONS

Sienko et al., Chemistry; McGraw–Hill Book Co., Inc., 1961, pp. 473, 474.

*Primary Examiner*—Earl C. Thomas
*Assistant Examiner*—Wayne A. Langel
*Attorney, Agent, or Firm*—Eric Y. Munson

[57] ABSTRACT

The present invention relates to a process for purifying metallurgical gases containing sulphuric anhydride by extracting mercury, using the sulphurous anhydride which accompanies the metallurgical gases as an oxidizing agent for the mercury, an additional contribution of sulphurous anhydride being made when the latter is deficient, and employing in addition an acid to facilitate the oxidization of the mercury and a soluble thiocyanate in order to complete the oxidation of the mercury.

14 Claims, No Drawings

PROCESS FOR PURIFYING METALLURGICAL GASES CONTAINING SULPHUROUS ANHYDRIDE BY EXTRACTING MERCURY

Although mercury in its inorganic forms, especially in its elemental state, cannot be considered to be seriously toxic, the possibility that it can be transformed into methyl-mercury, toxicity of which is extremely high, makes it advisable to decrease the mercury content of the residual gases from the plants carrying out the metallurgical beneficiation of cinnabar.

Until now, the greater part of the efforts directed towards the purification of gases containing mercury has been applied to the treatment of the gases produced in the chlorine-alkali plants. With respect to the residual gases in metallurgical plants, where mercury is accompanied by a greater or lesser content of sulphurous anhydride (and even sulphuric acid), up to the present time we do not know of any other patented process except that of the Finnish firm Outokumpu-Oy.

The process of this invention consists of putting the gases proceeding from a plant for the pyro-metallurgical treatment of mercury-bearing ores into contact with a solution of a soluble thiocyanate and an acid, utilizing the sulphurous anhydride that accompanies the gases (in the absence of which sulphurous anhydride it will be necessary to add it) as an oxydising agent for the mercury.

The gases to be treated are those proceeding from the plant and in which, in addition to mercury (inany of its forms) the presence of sulphurous anhydride, sulphuric acid, water vapour, dust and any other compound of the mineral treated and of the fuel used for the calcination may be expected to exist.

Likewise, this process can be applied to any other gas containing mercury provided that it is accompanied by a given concentration of sulphurous anhydride.

Likewise, the process which is the subject of this invention, and under the conditions specified below, collects the mercury present in the gas, leaving the said gas with a detectable content of less than 5 mg of mercury per cubic meter of gas.

The result of this process will be improved, to the extent that there is a greater or better contact between the solution and the gas to be purified.

It has been observed that the temperature of the solution of soluble thiocyanate and acid that has to retain the mercury from the gases has little influence on the result of the process since it is possible to work with the solution between freezing and boiling points, it being most suitable to carry out the process at the atmospheric temperature of the plant, since this will make the process more economical.

Irrespective of the temperature at which the gas is introduced, the process with which we are concerned will take place, since if the temperature is higher than, or of the order of 100°C, the corresponding vapourization of water will occur, and consequently the concentration of the solution that will have to be corrected; on the other hand, if the temperature of the gases is lower than that of the solution, it will have as a limit the freezing temperature of the solution. The most suitable temperature range for working is indicated as being between 10° and 100°C.

The range of concentration of the components of the solution is wide, the lower limit being 2 g/l of soluble thiocyanate and the upper limit being the saturation of the liquid with soluble thiocyanate at the temperature at which the process is to be carried out.

Likewise, for the acid, the concentrations are found between the lower limit of 2 g/l and the upper limit consisting of that concentration which does not affect the stability of the solution in the conditions under which the process is carried out.

The most suitable conditions for the carrying out of this process are: 150 g/l of soluble thiocyanate and 50 g/l of acid.

With respect to the concentration of sulphurous anhydride in the gas, the most suitable value lies between 1 per cent and 6 per cent in volume ($m^3$ N of $SO_2/m^3$ of gas). No improvement in yield in the recovery of mercury has been noted with values higher than 6 per cent of $SO_2$, as will be indicated below in the examples.

As far as the concentration of mercury in the gases to be purified is concerned, this can have a very wide margin, which may range from 5 mg $Hg/m^3$ of gas to about 20 g $Hg/m^3$ of gas.

The mercury content of the gas after its treatment is lower than 5 mg $Hg/m^3$ of gas, if the concentrations of sulphurous anhydride in the gas, on the one hand, and the concentrations of acid and thiocyanate in the solution, on the other hand, are the suitable concentrations indicated in this descriptive memorandum of the present invention.

The maximum concentration that mercury can reach in the solution that treats the gases will depend on the concentrations of thiocyanate and acid in the said solution, up to that value at which a slowing-down is observed in the process. A normal value for this concentration would be between the values comprised between 0 g Hg/l and 5 g Hg/l.

The recovery of mercury from this solution may be effected in various ways. By adding a solution of sodium sulphide the mercury is precipitated in the form of a sulfide.

Once part or all of the mercury retained in the solution has been recovered from it, the solution may be returned to the process, adjusting to the extent necessary, the concentrations of soluble sulphur cyanide and acid.

EXAMPLES

As the gases produced in the roasting of cinnabar always contain greater or lesser quantities of sulphurc acid, in principle, this acid has been spcifically selected for the tests on the solution that is going to be used for retaining the mercury encountered in the gases.

We explain below, by way of example, the most characteristic of a series of tests carried out.

EXAMPLE 1

A solution with 50 g/l of sulphuric acid and 150 g/l of potassium thiocyanate. Gases with 6 percent of sulphurous anhydride and mercury contents of between 8 $mg/m^3$ and 1 $g/m^3$. The residual gases have a mercury content lower than 5 $mg/m^3$ of gas.

EXAMPLE 2

A solution with 50 g/l of sulphuric acid and 110 g/l of potassium thiocyanate. Gases with 6 percent sulphurous anhydride and 150 $mg/m^3$ of mercury. The residual gases have a mercury content of less than 5 $mg/m^3$.

EXAMPLE 3

When the concentration of potassium thiocyanate fell to 90 g/l, with concentrations of sulphurous anhydride of 3 per cent and 150 $mg/m^3$ of mercury in the gases, the concentration of mercury in the residual gases was 6 mg/m$^3$: a value that rises to about 8.5 mg/m$^3$ when the content of sulphurous anhydride in the gases falls to 1 percent.

In all the examples cited, for the contact between liquid and gas a column 3 meters in height full of 10 mm. Raschig rings was used and a mass ratio between the flows of gas and liquid in the column of the order of 5. When this ratio is increased, it has been observed that the content of mercury in the residual gas increases slightly, and likewise when the height of the column is decreased.

The temperature of the solution in the column in all the tests varied between 10° and 40°C.

What is claimed is:

1. A process for purifying metallurgical gases by extracting mercury from such gases containing sulphurous anhydride comprising contacting the gases with a thiocyanate dissolved in an aqueous sulphuric acid solution, oxidizing the mercury by means of the sulphurous anhydride being present in an amount sufficient to act as an oxidizing agent for the mercury to be extracted, the sulfuric acid solution having an acidity sufficient to facilitate the oxidation of the mercury and the thiocyanate completing the oxidation of the mercury to be extracted.

2. A process as claimed in claim 1 wherein the extracted mercury in the solution is separated therefrom by precipitation.

3. A process as claimed in claim 2 wherein the precipitation of the extracted mercury is obtained by adding a solution of sodium sulfide to the solution.

4. A process as claimed in claim 2 wherein the extracting solution is recycled to the extraction process after the extracted mercury therein has been precipitated and after the thiocyanate and acid concentrations have been adjusted to their original values required for carrying out the mercury extraction by oxidation.

5. A process as claimed in claim 1 wherein the concentration of extracted mercury in the solution ranges up to 5 g/l.

6. A process as claimed in claim 1 wherein the sulphuric acid is in a concentration in the solution in the range of 2 g/l up to that amount which may be added without effecting solution stability under the process conditions.

7. A process as claimed in claim 6 wherein the sulphuric acid concentration is 50 g/l.

8. A process as claimed in claim 1 wherein the concentration of thiocyanate dissolved in the solution is in the range of 2 g/l up to that amount which produces saturation of the solution at the process temperature.

9. A process as claimed in claim 8 wherein the concentration of thiocyanate is 150 g/l.

10. A process as claimed in claim 1 wherein additional sulphurous anhydride is added to that already contained in the metallurgical gases from which mercury is to be extracted to provide an amount sufficient to act as an oxidizing agent for the mercury.

11. A process as claimed in claim 1 wherein the concentration of sulphurous anhydride is in the range of 1–6 percent, based on volume, of the gases.

12. A process as claimed in claim 1 wherein the concentration of mercury in the metallurgical gases is in the range 5 mg to 20 g per m$^3$ of gas.

13. A process as claimed in claim 1 wherein the mercury remaining in the gases after extraction is below 5 mg per m$^3$ of gas.

14. A process as claimed in claim 1 wherein the temperature of the gases is in the range of 10° to 100°C.

* * * * *